US006754357B2

(12) United States Patent
McIntosh et al.

(10) Patent No.: US 6,754,357 B2
(45) Date of Patent: Jun. 22, 2004

(54) EXPANDABLE IN-EAR DEVICE

(75) Inventors: Ian McIntosh, Alexandria (CA); Roger Saulce, Montréal (CA)

(73) Assignee: Sonomax Hearing HealthCare Inc., Montreal (CA)

( * ) Notice: Subject to any disclaimer, the term of this patent is extended or adjusted under 35 U.S.C. 154(b) by 0 days.

(21) Appl. No.: 10/349,545

(22) Filed: Jan. 21, 2003

(65) Prior Publication Data

US 2003/0112990 A1 Jun. 19, 2003

Related U.S. Application Data

(63) Continuation of application No. 09/785,278, filed on Feb. 20, 2001, now abandoned.

(51) Int. Cl.[7] ..... H04R 25/00
(52) U.S. Cl. ..... 381/322; 381/325; 381/328
(58) Field of Search ..... 381/322, 323, 381/324, 325, 327, 328, 330, 380; 181/128, 129, 130, 132, 135

(56) References Cited

U.S. PATENT DOCUMENTS

| | | | | |
|---|---|---|---|---|
| 2,719,523 A | | 4/1955 | Von Gierke | |
| 3,906,170 A | * | 9/1975 | Guice | 381/322 |
| 4,133,984 A | | 1/1979 | Akiyama | |
| 4,712,245 A | | 12/1987 | Lyregaard | |
| 5,006,055 A | | 4/1991 | Lebisch et al. | |
| 5,131,411 A | | 7/1992 | Casali et al. | |
| 5,249,234 A | * | 9/1993 | Butler | 381/322 |
| 5,333,622 A | | 8/1994 | Casali et al. | |
| 6,058,198 A | | 5/2000 | Aceti et al. | |
| 6,339,648 B1 | | 1/2002 | McIntosh et al. | |
| 6,359,993 B2 | | 3/2002 | Brimhall | |

* cited by examiner

*Primary Examiner*—Suhan Ni

(57) ABSTRACT

An expandable in-ear device being implantable within an ear canal of an individual and being customizable in-situ to the shape of the ear canal, and cavum concha, using a settable compound. The device includes a core-form with a nipple extending from a platform, the nipple and the platform being insertable into the ear canal and the cavum concha, respectively. A sound bore extends through the nipple from a position located outside the ear canal to a position located inside for allowing sound transmission therethrough. A deformable sheath attached integrally to the core-form is deformable between an unfolded configuration and a folded configuration. In the unfolded configuration, the sheath extends generally away from the core-form. The sheath is foldable inside-out from the unfolded configuration to the folded configuration wherein the sheet substantially covers the core-form while defining a spacing between the sheath and the core-form, the spacing being fillable by the settable compound.

20 Claims, 2 Drawing Sheets

10
20
21
22
24
27
28
30
31
32
33
35
37
40
41
42
50
51
52
60
61
62
70
71
5
6

10
20
21
21d
22
23
25
26
27
28
30
32
33
35
36
37
38
40
41
50
52
60
61
62
63
70
70a
71
72
73
S
N
V
C

EXPANDABLE IN-EAR DEVICE

CROSS-REFERENCE TO RELATED APPLICATION

The present application is a Continuation application of U.S. patent application Ser. No. 09/785,278 filed on Feb. 20, 2001, now abandoned.

FIELD OF THE INVENTION

The present invention generally relates to in-ear devices such as earplugs, hearing aid devices and the like, and more particularly, to custom-fitting in-ear devices that are formed in-situ to perfectly assume the inside of the ear canal and cavum concha of an individual.

BACKGROUND OF THE INVENTION

Hearing protection devices (HPDs) are often passive (i.e. not powered) and some simply amount to a plug in the ear; while more sophisticated (but still passive) HPDs may include acoustic chambers and filters, for passing or attenuating selected frequencies.

The term hearing device includes active devices, either of a hearing protection nature, or of a hearing aid nature, in which some or all of the batteries and other components are mounted behind the ear, or remotely, in a box, which communicates with the in-ear unit by means of a sound-tube, or by wires; and includes active devices in which a microphone, speaker, and all the associated sound-processing circuitry and components, including a battery, are contained within the in-ear unit.

Recent trends in digital hearing devices seek to overcome the traditional inconsistency-of-fit problem by providing multi-channel sound transmission.

The expectation that a good fit can be achieved quickly, every time, gives a new incentive to the development of the audio side of hearing-aid (and hearing-protection) technology.

It is recognized that the performance of all in-ear hearing devices is highly dependent upon the fit of the device in the ear. If the HPD is a poor fit, sound simply by-passes around the HPD. The tendency therefore is for the HPD to be too tight, which leads to poor wearer-comfort, whereby the wearer tends not to keep the HPD in for long periods.

Recent development in hearing aids aimed at by-passing the need for a good fit, by eliminating feedback.

Different in-ear devices are presently used in a wide range of human activities. From the performance standpoint, HPDs, like hearing aids, really have to be custom-fitted.

U.S. Pat. No. 5,006,055 issued to Lebisch et al. on Aug. 4, 1989 discloses an apparatus for manufacturing in-ear device directly in the ear of a hearing-impaired person with a deformable envelope being pulled over a die or over a shell or over an overlayed over-shell. This rather long and tedious process requires many steps of assembly.

U.S. Pat. Nos. 5,333,622 and 5,131,411 issued to Casali et al. on Aug. 2, 1994 and on Jul. 21, 1992 respectively disclose a custom-molded earplug that can be used for selecting pre-sized earplugs or as a cast for creating a mold for earplugs or hearing aids. This earplug is not appropriate for custom fitting in-situ of an ear canal of an individual.

Canadian patent application No. 2,302,962/A1 of McIntosh et al. filed on Mar. 23, 2000 and laid open on Sep. 26, 2000 discloses a hearing apparatus adapted to be inflated in-situ using an inflation-medium. The apparatus includes a core portion that is generally covered by a separate sheath. The proper installation of the sheath requires extensive delicate care, especially when bonding the far end of the sheath to the core using the far-seal-means without obstructing the acoustic tube.

SUMMARY OF THE INVENTION

It is therefore a general object of the present invention to provide an improved expandable in-ear device, that obviates the above-mentioned disadvantages.

An advantage of the present invention is that the expandable in-ear device can be very properly re-inserted by an individual repeatedly.

Another advantage of the present invention is that the expandable in-ear device is molded out into a single piece.

Still another advantage of the present invention is that the expandable in-ear device is customized depending on the user's need to be an earplug, a filtered earplug, a hearing aid device, a communication device or the like.

Still a further advantage of the present invention is that the expandable in-ear device is comfortable for users.

Yet another advantage of the present invention is that the expandable in-ear device is adaptable to be side specific, either a left or right hand side device.

According to the present invention, there is provided an expandable in-ear device, the in-ear device being implantable within an ear canal of an individual and being customizable in-situ to the shape of the ear canal using a settable compound, the in-ear device comprises: a core-form defining a nipple section thereof, the nipple section being insertable into the ear canal; a sound bore extending through the nipple section from a position located outside the ear canal to a position located inside the ear canal for allowing sound transmission therethrough, and a deformable sheath extending integrally from the core-form, the deformable sheath being deformable between a sheath first configuration and a sheath second configuration wherein when the sheath is in the sheath first configuration the sheath extends generally away from the nipple section while remaining attached to the core-form, the sheath being foldable inside-out from the sheath first configuration to the sheath second configuration wherein the sheath is in a generally overlying relationship relative to the core-form so as to substantially cover the nipple section while defining a spacing between the sheath and the core-form, the spacing being fillable by the settable compound.

Typically, the core-form further defines a platform section, the platform section defining a platform distal end and a generally opposed platform proximal end, the nipple section extending generally away from a position adjacent the proximal end of the platform section, the nipple section defining a nipple distal end and a generally opposed nipple proximal end; the sheath extending integrally away from a position adjacent the nipple proximal end when in the sheath first configuration and being in a generally overlying relationship relative to the core-form so as to substantially cover the nipple and platform sections when in the sheath second configuration, the sheath defining an opening therethrough, the opening generally overlying the platform distal end when the sheath is in the sheath second configuration.

Typically, the platform distal end includes a delimited area slightly protruding away therefrom, the opening of the sheath having a shape to generally assume a perimeter of the delimited area.

Typically, the sound bore extends generally from a position adjacent the nipple proximal end inside the ear canal to a position adjacent the platform distal end outside the ear canal.

Typically, the platform section includes a cavity extending generally inwardly thereinto from a position adjacent the platform distal end, the in-ear device further comprising an insert member removably tightly engaging the cavity of the platform section, and a second sound bore extending generally from a position adjacent the nipple proximal end to the cavity of the platform section through both of the nipple and platform sections for allowing sound transmission therethrough.

In one embodiment, the insert member is a plug member to close the second sound bore, whereby the in-ear device is an earplug device.

In one embodiment, the insert member includes a communication element for sound communication with the second sound bore.

Typically, the communication element is a band-pass filter for allowing an acceptable frequency range to reach inside the ear canal, whereby the in-ear device is a filtered earplug device.

Alternatively, the communication element is a second cavity extending generally inwardly into the insert member for being releasably engaged by an electronic circuit member that amplifies and transmits sound within a predetermined frequency range from outside the ear canal to the second sound bore, whereby the in-ear device is a hearing aid device.

Alternatively, the communication element is a sound bore extension extending through the insert member, the sound bore extension communicating with the second sound bore at a proximal end thereof and for being engaged by an external hearing aid device at a distal end thereof, whereby the in-ear device is a hearing aid adaptable device.

Typically, the first sound bore is terminated at a position adjacent the platform distal end by a slit opening, the slit opening closing the first sound bore whenever not engaged by a remote instrument.

In one embodiment, the in-ear device further comprises a handle member secured to a position generally adjacent the platform distal end.

Typically, the handle member includes a notch to engage a corresponding recess on the platform section for properly positioning the handle member relative to the core-form, the handle member having a longitudinal reach-through hole for guiding an injection device containing the settable compound material into a slit channel within the platform section, the slit channel communicating with the spacing so as to allow the settable compound to flow from the slit channel to the spacing.

Typically, the slit channel self closes upon retraction of the injection device therefrom.

In one embodiment, the platform distal end is generally symmetrical and formed by two planar surfaces having a common distal edge and extending generally downwardly away from each other in a direction towards the platform proximal end, one of the two surfaces including the delimited area while the other of the two surfaces being fully covered by the sheath when the sheath is in the sheath second configuration and being customizable in-situ to the shape of a cavum concha of the individual corresponding to the ear canal.

Other objects and advantages of the present invention will become apparent from a careful reading of the detailed description provided herein, with appropriate reference to the accompanying drawings.

BRIEF DESCRIPTION OF THE DRAWINGS

In the annexed drawings, like reference characters indicate like elements throughout.

DETAILED DESCRIPTION OF THE PREFERRED EMBODIMENTS

Figures 1, 2, 3, 4:
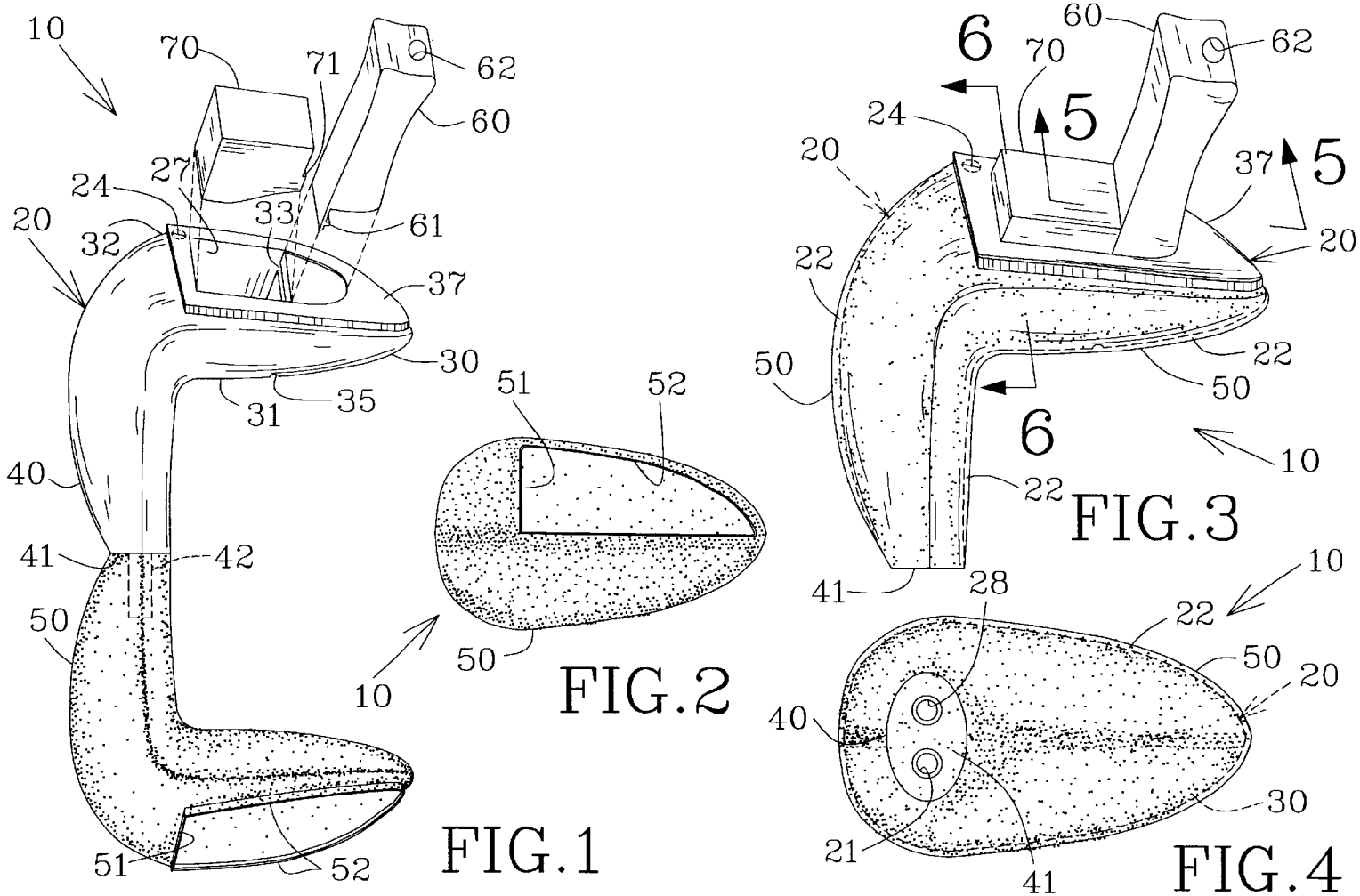
FIG. 1 is an exploded side view of an embodiment of an expandable in-ear device according to the present invention; showing the integral sheath extending out of the core-form.
FIG. 2 is a bottom view of the embodiment of FIG. 1.
FIG. 3 is a side view of the embodiment of FIG. 1 with the sheath folded inside-out over the core-form.
FIG. 4 is a bottom view of the embodiment of FIG. 2.

With reference to the annexed drawings the preferred embodiments of the present invention will be herein described for indicative purpose and by no means as of limitation.

Referring to FIGS. 1 to 8, there is shown an embodiment 10 of an expandable in-ear device according to the present invention. The device 10 is adapted for being customizable in-situ to the shape of the ear canal C and cavum concha V of an individual. The device 10 includes a core-form 20 having a platform section 30 with a nipple section 40 integral to and extending from a proximal end 31 of the same for engaging the canal C. A sound bore 21 extends generally from a position adjacent a proximal end 41 of the nipple section 40 to a position adjacent a distal end 32 of the platform section 30 through both the nipple 40 and the platform 30 sections, for conducting sound from an environment outside the ear canal C to inside of the ear canal C. A stretchable or deformable sheath 50, shown in an unfolded configuration in FIG. 1, extends integrally away from the proximal end 41 of the nipple section 40 of the core-form 20 in a sheath first configuration or an unfolded configuration thereof. The sheath 50 is substantially a replication of the shape of the core-form 20 and has an opening 51 adapted for assuming the distal end 32 of the platform section 30. The sheath 50 is adapted to be folded inside-out over the core-form 20 and substantially assume the same in a generally overlying relationship relative to the core-form 20 so as to substantially cover the latter, and defines an in-between region or spacing 22 there between in a sheath second configuration or a folded configuration of the sheath 50, as shown in a folded configuration in FIG. 3. The platform section 30 is adapted for allowing a settable compound material 23 to be injected therethrough, reach and fill the in-between region 22 and stretch or deform the sheath 50 away from the core-form 20 to generally assume and occlude the ear canal C and the cavum concha V when the device 10 is engaging the same, thereby forming a unitary piece with said device 10 after the settable compound material 23 is fully set. For obvious reasons to one skilled in the art, the in-between region 22 does not communicate with the sound bore 21.

The in-ear device 10 also preferably includes a handle member 60 secured, preferably glued, to a position adjacent the distal end 32 of the platform section 30. In order to properly position the handle 60 relative to the core-form 20, the handle 60 preferably has a notch 61 for engaging a corresponding recess 33 on the platform section 30, as shown in FIG. 5.

To ensure a better flow of the settable compound material 23 inside the in-between region 22 of the device 10, the proximal end 31 of the platform section 30 includes a preferably semi-circular aperture 35, in proximity of the nipple section 40, as illustrated in FIG. 1. To allow for the compound material 23 to reach the in-between region 22 via the aperture 35 from the distal end 32 of the platform 30, a communicating slit channel 36 is made to releasably receive a needle N of an injection device such as a syringe S containing the settable compound material 23. Obviously, the slit channel 36 is made using a sharp tool perforating the platform 30 prior to folding the sheath 50 over the core-form 20, thereby not damaging the sheath 50. The handle 60 preferably has a longitudinal reach-through hole 62 for alternatively guiding the perforating tool and the needle N of the syringe S (shown in dashed lines in FIG. 7).

The hole 62 of said handle member is preferably closed off by a thin membrane 63 getting in contact with the core-form 20 in order to prevent any back flow of glue within the hole 62 when the handle 60 is glued onto the platform 30. Similarly, to prevent any back flow of the settable compound material 23 just after injection of the same inside the in-between region 22, the slit channel 36 is preferably self closing upon retraction of the needle N from the same.

Figures 5, 6, 7, 8:
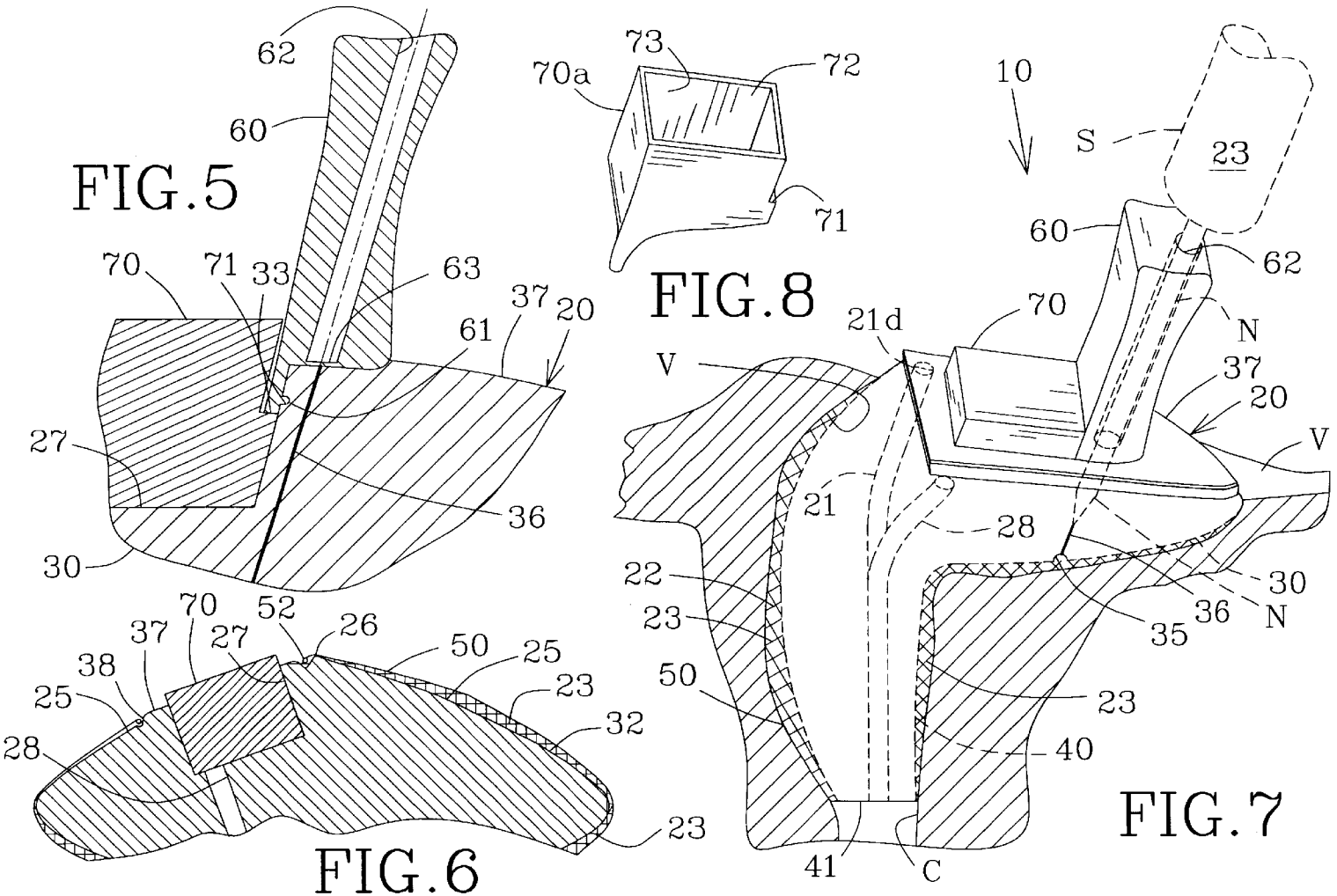
FIG. 5 is a partial enlarged section view taken along line 5—5 of FIG. 3; showing the handle member secured to the platform section.
FIG. 6 is an enlarged section view taken along line 6—6 of FIG. 3.
FIG. 7 is a section view of the embodiment of FIG. 2 inserted in the ear canal and cavum concha of an individual and being expanded by a settable compound material to perfectly assume the same.
FIG. 8 is a perspective view of another embodiment of the insert member engaging the cavity.

As shown in FIG. 7, the distal end 32 of the platform 30 includes a delimited area 37 slightly protruding away from the same. Accordingly, the opening 51 of the sheath 50 has a shape to assume the perimeter of the delimited area 37. Preferably, the opening 51 has a perimeter reinforced with a collar 52 integral to the same for tightly engaging a corresponding groove 38 on the perimeter of the delimited area 37. The collar 52 of the perimeter of the opening 51 is preferably bonded (or glued) into the groove 38 of the delimited area 37 to close off the in-between region 22. The distal extremity 21*d* of the sound bore 21 is located within the delimited area 37 and is preferably terminated by a slit membrane 24 closing the same whenever not engaged by a remote instrument (not shown) such as a microphone of a measurement apparatus or the like.

Also illustrated in FIGS. 2 and 6, the distal end 32 of the platform 30 is preferably generally symmetrical and formed by two planar surfaces 25 having a common distal edge 26 and extending generally downwardly away from each other in a direction towards the platform proximal end 31. Only one of the two surfaces 25 includes the delimited area 37 while the other one is fully covered by the sheath 50 in the folded configuration of the in-ear device 10. Similarly, the opening 51 of the sheath 50 is located on the same side as the corresponding area 37. This tilt of the surfaces 25 enables the device 10 to be side specific, either a left or right hand side device and have only the handle 60 protruding out of the ear of the individual.

Furthermore, because of the conical aspect of the nipple section 40, the device 10 needs a retaining member to prevent it from coming out of the ear canal C. Accordingly, the side of the platform 30 with the surface 25 entirely covered by the sheath 50 is adapted to sit into the cavum concha V of the ear and provide the required retention.

After the handle 60 has been installed and the slit channel 36 has been made, the sheath 50 is progressively folded inside-out over the core-form 20. Preferably, the sheath 50 tightly assumes the core-form 20 such that the in-between region 22 is substantially fluidless, with no air entrapped therein. For safety, after folding of the sheath 50 its opening 51 is bonded all around the area 37, then the in-between region 22 is vacuumed to remove air entrapped therein. At this time, the device 10 is ready to be inserted into the ear canal C and have the settable compound material 23 injected into the in-between region 22 for the in-situ custom fitting of the device 10, as shown in FIG. 7. The sheath 50 is then pushed away from the core-form 20 to perfectly assume and occlude the ear canal C. Similarly, the retaining member area of the device 10 also have an extension of the in-between region 22 adapted to be filled, preferably simultaneously with the in-between region 22, by the settable compound material so as to perfectly assume the shape of the cavum concha V of the individual. The device 10 is then removed from the ear canal C after the compound material 23 is set.

The core-form 20 is generally solid and rigid enough with substantial inherent structural rigidity while the stretchable sheath 50 is a thin material with substantially no inherent structural rigidity, both of them being a single molded member made out of a silicone type of material or the like with a hardness value of preferably less than thirty (30) shore-A. Accordingly, the protrusion 42 (see FIG. 1) at the proximal end 41 of the nipple section 40 are preferably only for molding purposes of the sound bores 21, 28. They are preferably simply chopped off after folding over of the sheath 50, as shown in FIGS. 3 and 4. The settable compound material 23 is preferably a rubber like type material once it is fully cured with a hardness value of preferably less than thirty (30) shore-A.

Additionally, the in-ear device 10 includes an insert member 70 removably tightly engaging a cavity 27 located within the delimited area 37 the platform section 30, and a second sound bore 28 generally extending from a position adjacent the proximal end 41 of the nipple section 40 to a position adjacent the cavity 27 of the platform 30 for allowing sound transmission between the cavity 27 and the inside of the ear canal C. The insert 70 is preferably locked in place by a locking step 71 releasably engaging the handle 60. The second sound bore 28 runs generally parallel to the first one 21 except at the distal end 32 of the platform 30 where it diverges away therefrom.

Both the handle 60 and the insert 70 are preferably made out of silicone type material or the like having a hardness value typically varying between fifty (50) and eighty (80) shore-A.

As shown in FIGS. 1 to 7, the insert member 70 can be a plug member to simply close off the second sound bore 28, whereby the device 10 is an earplug device.

Optionally, the insert member 70 includes a communication element 72 for communicating with the second sound bore 28. Accordingly, the communication element 72 can be a band-pass filter, preferably in the form of an adequately sized extension of the second sound bore 28, for allowing an acceptable frequency range to reach inside the ear canal C, whereby the device 10 is a filtered earplug device.

Also, as shown in FIG. 8, the communication element 72 of the insert 70*a* can be a cavity 73 adapted to be releasably engaged by an electronic circuit (not shown and well known in the art) that amplifies and transmits sound within a pre-determined frequency range from the environment outside the ear canal C to the second sound bore 28, whereby the device 10 is a hearing aid device, more commonly known as an in the ear (ITE) hearing aid. Similarly, the communication element 72 could be a simple sound bore extension, (not shown) adapted to be engaged by an external hearing aid device, such as a commonly known behind the ear (BTE) hearing aid or the like, at a distal extremity and communicating with the second sound bore 28 at a proximal extremity, whereby the device 10 is a hearing aid adaptable device.

To prevent an individual from loosing his/her in-ear devices 10 of the present invention, each hole 62 of both handles 60 can be releasably engaged by a respective resilient plug member (not shown) secured to a respective extremity of a cord or the like, thereby securing both devices 10 together.

Although the present expandable in-ear device has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

We claim:

1. An expandable in-ear device, said in-ear device being implantable within an ear canal of an individual and being customizable in-situ to the shape of the ear canal using a settable compound, said in-ear device comprising:

a core-form defining a nipple section thereof, said nipple section being insertable into the ear canal, a sound bore extending through said nipple section from a position located outside the ear canal to a position located inside the ear canal for allowing sound transmission therethrough, and a deformable sheath extending integrally from said core-form, said deformable sheath being deformable between a sheath first configuration and a sheath second configuration wherein when said sheath is in said sheath first configuration said sheath extends generally away from said nipple section while remaining attached to said core-form, said sheath being foldable inside-out from said sheath first configuration to said sheath second configuration wherein said sheath is in a generally overlying relationship relative to said core-form so as to substantially cover said nipple section while defining a spacing between said sheath and said core-form, said spacing being fillable by the settable compound.

2. A device as defined in claim 1, wherein said core-form further defines a platform section, said platform section defining a platform distal end and a generally opposed platform proximal end, said nipple section extending generally away from a position adjacent said proximal end of said platform section, said nipple section defining a nipple distal end and a generally opposed nipple proximal end;

said sheath extending integrally away from a position adjacent said nipple proximal end when in said sheath first configuration and being in a generally overlying relationship relative to said core-form so as to substantially cover said nipple and platform sections when in said sheath second configuration, said sheath defining an opening therethrough, said opening generally overlying said platform distal end when said sheath is in said sheath second configuration.

3. A device as defined in claim 2, wherein said platform distal end includes a delimited area slightly protruding away therefrom, said opening of said sheath having a shape to generally assume a perimeter of said delimited area.

4. A device as defined in claim 3, wherein said opening of said sheath has a perimeter reinforced with a collar extending integrally from said sheath for tightly engaging a corresponding groove on said perimeter of said delimited area of said platform distal end, thereby closing said spacing.

5. A device as defined in claim 3, wherein said platform distal end is generally symmetrical and formed by two planar surfaces having a common distal edge and extending generally downwardly away from each other in a direction towards said platform proximal end, one of said two surfaces including said delimited area while the other of said two surfaces being fully covered by said sheath when said sheath is in said sheath second configuration and being customizable in-situ to the shape of a cavum concha of the individual corresponding to the ear canal.

6. A device as defined in claim 2, wherein said sound bore extends generally from a position adjacent said nipple proximal end inside the ear canal to a position adjacent said platform distal end outside the ear canal.

7. A device as defined in claim 2, wherein said platform section includes a cavity extending generally inwardly thereinto from a position adjacent said platform distal end, said in-ear device further comprising an insert member removably tightly engaging said cavity of said platform section, and a second sound bore extending generally from a position adjacent said nipple proximal end to said cavity of said platform section through both of said nipple and platform sections for allowing sound transmission therethrough.

8. A device as defined in claim 7, wherein said insert member is a plug member to close said second sound bore, whereby said in-ear device is an earplug device.

9. A device as defined in claim 7, wherein said insert member includes a communication element for sound communication with said second sound bore.

10. A device as defined in claim 9, wherein said communication element is a band-pass filter for allowing an acceptable frequency range to reach inside the ear canal, whereby said in-ear device is a filtered earplug device.

11. A device as defined in claim 9, wherein said communication element is a second cavity extending generally inwardly into said insert member for being releasably engaged by an electronic circuit member that amplifies and transmits sound within a pre-determined frequency range from outside the ear canal to said second sound bore, whereby said in-ear device is a hearing aid device.

12. A device as defined in claim 9, wherein said communication element is a sound bore extension extending through said insert member, said sound bore extension communicating with said second sound bore at a proximal end thereof and for being engaged by an external hearing aid device at a distal end thereof, whereby said in-ear device is a hearing aid adaptable device.

13. A device as defined in claim 2, wherein said first sound bore is terminated at a position adjacent said platform distal end by a slit opening, said slit opening closing said first sound bore whenever not engaged by a remote instrument.

14. A device as defined in claim 9, further comprising a handle member secured to a position generally adjacent said platform distal end.

15. A device as defined in claim 14, wherein said handle member is glued to said platform section of said core-form.

16. A device as defined in claim 14, said handle member includes a notch to engage a corresponding recess on said platform section for properly positioning said handle member relative to said core-form, said handle member having a longitudinal reach-through hole for guiding an injection device containing the settable compound material into a slit channel within said platform section, said slit channel communicating with said spacing so as to allow the settable compound to flow from said slit channel to said spacing.

17. A device as defined in claim 16, wherein said hole of said handle member is closed off by a thin membrane in contact with said core-form.

18. A device as defined in claim 16, wherein said slit channel self closes upon retraction of the injection device therefrom.

19. A device as defined in claim 1, wherein said sheath tightly covers said core-form with said spacing being substantially fluidless when said sheath is in said sheath second configuration.

20. A device as defined in claim 1, wherein said in-ear device is a single molded member.

* * * * *